US008240963B2

(12) United States Patent
Estrada

(10) Patent No.: US 8,240,963 B2
(45) Date of Patent: Aug. 14, 2012

(54) CARGO HOLD-DOWN DEVICE FOR A LOAD-CARRYING BED OF A VEHICLE

(75) Inventor: Steven T. Estrada, Lincoln, AL (US)

(73) Assignee: Honda Motor Co., Ltd., Tokyo (JP)

( * ) Notice: Subject to any disclaimer, the term of this patent is extended or adjusted under 35 U.S.C. 154(b) by 225 days.

(21) Appl. No.: 12/751,205

(22) Filed: Mar. 31, 2010

(65) Prior Publication Data

US 2011/0243682 A1 Oct. 6, 2011

(51) Int. Cl.
*B60P 7/135* (2006.01)

(52) U.S. Cl. ..... 410/121

(58) Field of Classification Search ..... 410/121, 410/77

See application file for complete search history.

(56) References Cited

U.S. PATENT DOCUMENTS

| | | | | |
|---|---|---|---|---|
| 2,570,802 | A * | 10/1951 | Hatteburg | 224/405 |
| 2,855,217 | A | 10/1958 | Bagwell | |
| 4,121,849 | A | 10/1978 | Christopher | |
| 4,869,628 | A | 9/1989 | Fletcher | |
| 5,271,127 | A | 12/1993 | Christensen | |
| 5,338,136 | A * | 8/1994 | Hetchler | 410/100 |
| 5,387,070 | A * | 2/1995 | Roeling | 414/483 |
| 5,542,815 | A * | 8/1996 | Roeling | 414/812 |
| 5,961,263 | A | 10/1999 | Nunez | |
| 6,168,359 | B1 * | 1/2001 | Smith | 410/38 |
| 6,193,452 | B1 | 2/2001 | Skiba | |
| 6,203,259 | B1 | 3/2001 | Christensen | |
| 6,471,455 | B2 * | 10/2002 | Skiba | 410/38 |
| 6,632,055 | B2 * | 10/2003 | Kania | 410/38 |
| 6,830,418 | B2 * | 12/2004 | Keramidis | 410/38 |
| 7,246,731 | B1 * | 7/2007 | Matherne, Sr. | 224/403 |
| 7,494,169 | B2 * | 2/2009 | Collins | 296/3 |
| 7,736,105 | B2 * | 6/2010 | Landry | 410/7 |
| 7,785,050 | B2 * | 8/2010 | Fonseca, Jr. | 410/7 |
| 7,841,815 | B1 * | 11/2010 | Lane | 410/100 |
| 7,901,168 | B2 * | 3/2011 | Fa-Kouri | 410/23 |
| 7,909,553 | B2 * | 3/2011 | Snyder | 410/100 |
| 2005/0191142 | A1 * | 9/2005 | Rozell | 410/2 |
| 2005/0220557 | A1 * | 10/2005 | Rorie et al. | 410/7 |
| 2007/0224011 | A1 | 9/2007 | Cunningham | |

* cited by examiner

*Primary Examiner* — H Gutman
(74) *Attorney, Agent, or Firm* — Rankin Hill & Clark LLP

(57) ABSTRACT

A cargo hold-down device for securing cargo within a load-carrying bed of a vehicle comprises an engagement device and a retaining device. The engagement device has a proximal end portion and a distal end portion for engaging cargo located within the load-carrying bed. The retaining device movably mounts the proximal end portion of the engagement device to the load-carrying bed and selectively holds the distal end portion of the engagement device tightly against the cargo in a secured position.

19 Claims, 16 Drawing Sheets

CARGO HOLD-DOWN DEVICE FOR A LOAD-CARRYING BED OF A VEHICLE

BACKGROUND

Exemplary embodiments herein generally relate to a load-carrying bed of a vehicle, and more particularly relate to a cargo hold-down device for securing cargo within the load-carrying bed.

Vehicles having load-carrying beds (e.g., pickup trucks) are commonly used to facilitate transportation of cargo items from one location to another, such as through placement of cargo items in the bed. While such vehicles are available in many sizes and configurations, a typical load-carrying bed vehicle includes a bed floor that can support the cargo items. A typical load-carrying bed also includes a headboard structure and side walls to help restrain cargo within the bed. Sometimes a tailgate or other closure is provided along an open end of the bed (i.e., the end opposite the headboard).

Frequently it is necessary to carry lengthy cargo, such as ladders, pipe, lumber, plastic siding, other construction materials, etc. that are typically longer than the length of the load-carrying bed, even with the tailgate down. In such cases, the cargo is typically tied down with rope or straps and possibly weighted with cement blocks or other heavy objects. Such methods of retaining the cargo are inconvenient, time consuming and potentially very unsafe in the event the cargo drops from the vehicle to the road surface.

A variety of devices have been used to retain cargo within the load-carrying bed of the vehicle. One known retaining device includes horizontal bars which are mounted on horizontal tracks to retain cargo in position inside the truck. Another known retaining device includes a horizontal bar moveable vertically on posts which are, in turn, positionable on vertical tracks formed in the side walls of the load-carrying bed. However, the known retaining devices are bulky, inconvenient to use and sometimes expensive to manufacture. Cargo bed liners for pickup trucks have also been modified to retain items within the load-carrying bed. These bed liners, however, typically only retain items with partitions within the bed to prevent sliding around in the bed. There are no features directed to retaining lengthy cargo that extends well beyond the load-carrying bed.

SUMMARY

According to one aspect, a cargo hold-down device for securing cargo within a load-carrying bed of a vehicle comprises an engagement device and a retaining device. The engagement device has a proximal end portion and a distal end portion for engaging cargo located within the load-carrying bed. The retaining device movably mounts the proximal end portion of the engagement device to the load-carrying bed and selectively holds the distal end portion of the engagement device tightly against the cargo in a secured position.

According to another aspect, a cargo hold-down device for securing lengthy cargo within a load-carrying bed of a vehicle comprises a lengthwise adjustable arm and a retaining device. The lengthwise adjustable arm has a first end portion mounted to a forward wall of the load-carrying bed and a second end portion movable relative to the first end portion for engaging cargo located within the load-carrying bed. The retaining device is configured to pivotally mount the first end portion of the arm to the forward wall. The retaining device allows for incremental angular adjustments of the second end portion of the arm toward the cargo to hold the second end portion of the arm tightly against the cargo in a secured position.

According to yet another aspect, a cargo hold-down device for securing cargo within a load-carrying bed of a vehicle comprises a lengthwise adjustable arm and a ratchet mechanism. The lengthwise adjustable arm has a first end portion and a second deformable end portion. The first end portion is mounted to a forward wall of the load-carrying bed. The second end portion engages cargo located within the load-carrying bed. The ratchet mechanism is configured to pivotally mount the first end portion of the arm to the forward wall. The ratchet mechanism holds the second end portion of the arm tightly against the cargo in a secured position.

DETAILED DESCRIPTION

Figure 1:
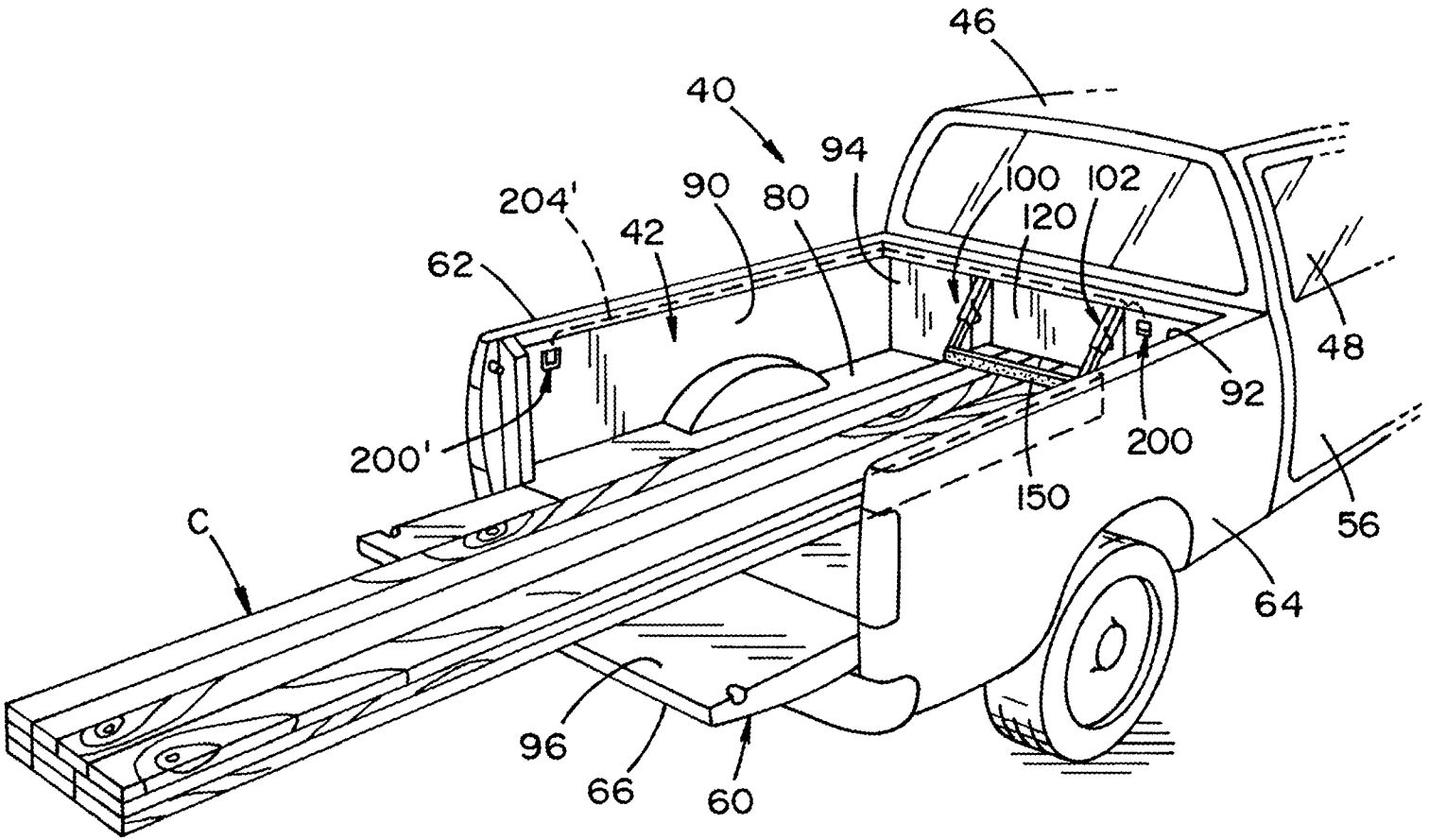
FIG. 1 is a side perspective view of a vehicle having a load-carrying bed. An exemplary cargo hold-down device according to one aspect of the present disclosure is provided on the load-carrying bed for securing cargo within the load-carrying bed.

It should, of course, be understood that the description and drawings herein are merely illustrative and that various modifications and changes can be made in the structures disclosed without departing from the present disclosure. It will also be appreciated that the various identified components of the vehicle and exemplary hold-down device disclosed herein are merely terms of art that may vary from one manufacturer to another and should not be deemed to limit the present disclosure. All references to direction and position, unless otherwise indicated, refer to the orientation of the exemplary cargo hold-down device illustrated in the drawings and should not be construed as limiting the claims appended hereto.

Referring now to the drawings, wherein like numerals refer to like parts throughout the several views, FIG. 1 illustrates an exemplary vehicle or truck 40 including a load-carrying bed 42. The bed 42 is configured to hold cargo C. The illustrated vehicle 40 is in the form of a pick-up truck including a cab portion 46 having a passenger compartment 48 and an engine compartment (not shown), both disposed forward of the bed 42. Although the passenger compartment 48 is depicted as being a pickup truck style cab having only two passenger doors (e.g., 56), it is to be understood that it could be virtually any type of cab, including for example, an extended cab and a crew cab (e.g., with four passenger doors), and to be further understood that the vehicle 40 could be any type of vehicle having a load-carrying bed. Additionally, although the bed 42 is shown in FIG. 1 to include vertically-rising walls (e.g., a headboard, side walls, and tailgate, to be later discussed) along four sides of the bed's cargo carrying floor, it should be understood that the bed 42 might have a substantially flat cargo carrying floor that is unbounded by the headboard, side walls and/or a tailgate, such as would be typical of a flat-bed type truck.

In the illustration of FIG. 1, the bed 42 includes a tailgate 60 for restraining objects within the bed 42 during movement of the vehicle 40. However, the bed 42 might alternatively include a net or cage in lieu of the tailgate (or some other type of restraint device), or perhaps might not include any such rear cargo restraint whatsoever. The illustrated bed 42 is shown to generally include a plurality of outer body components, including a left outer body panel 62, a right outer body panel 64, and outer portion or skin 66 of tailgate 60. Such outer body components 62, 64, 66 can be formed from any of a variety of materials such as steel, aluminum, plastic, fiberglass, composites, and/or a combination thereof. In one exemplary embodiment, one or more outer body components comprise painted steel sheets. In yet a further embodiment, at least one of the outer body components is formed from plastic.

The bed 42 can further include one or more inner bed components that substantially define the primary cargo carrying compartment of the bed. Such inner bed components can include, for example, a bed floor 80, a left side member 90, a right side member 92, a headboard member or forward wall 94, and/or an inner portion 96 of the tailgate 60. The side members 90, 92, and the headboard member or forward wall 94 can extend upwardly from a location adjacent to at least a portion of the bed floor 80. The members 90, 92, 94 and the tailgate portion 96 can assist in restraining cargo within the truck bed portion 42. The inner bed components can be formed from any number of materials, as for example, steel, aluminum, plastic, fiberglass, composites, and/or a combination thereof.

Figure 3:
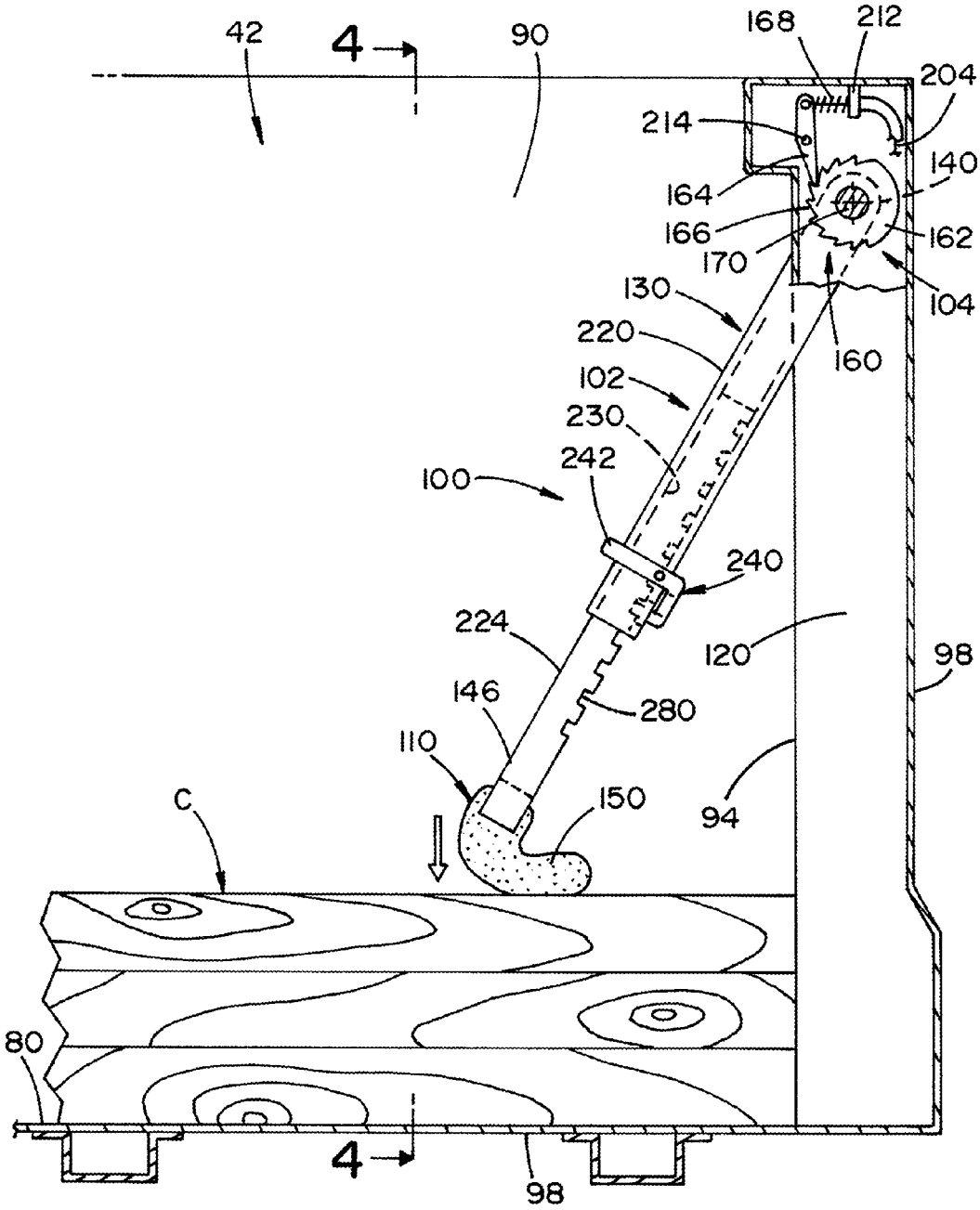
FIG. 3 is a partial cross-sectional view of the load-carrying bed of FIG. 1 showing the cargo hold-down device in a secured position tightly against the cargo.

The inner bed components can be supported by an underlying vehicle frame support structure 98 (FIG. 3). The support structure can be in a fixed position relative to the vehicle 40, and in some embodiments can be secured to a frame or unibody of the vehicle 40 such as with welds, bolts, or other fastening devices, means, etc. In another embodiment, the support structure might be integral with the pickup truck's frame or unibody. In one embodiment, the support structure can comprise steel, aluminum, one or more other metals, and/or a combination thereof; alternatively, the support structure could be formed of an alternate material or combination of material.

Figure 4:
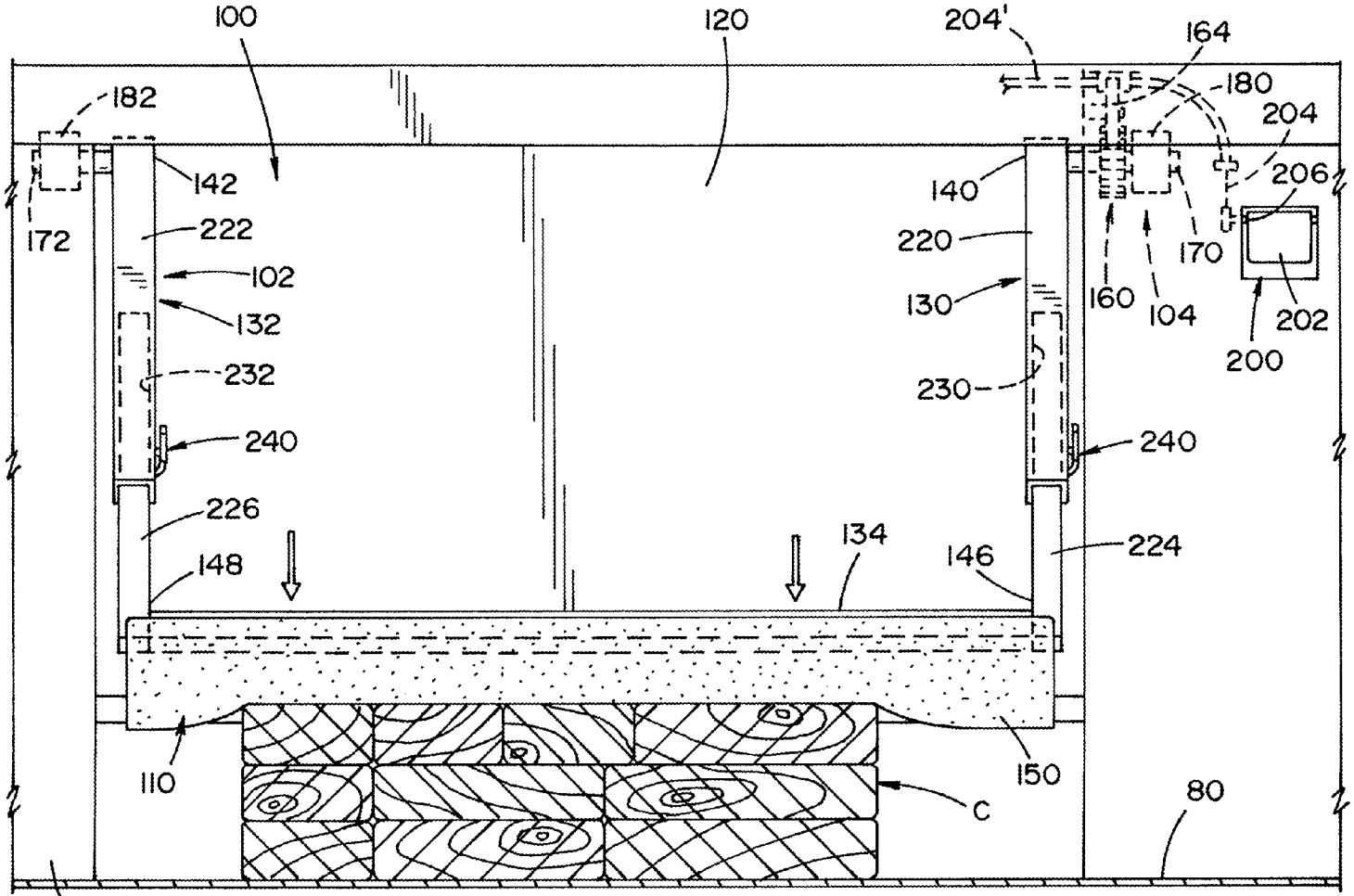
FIG. 4 is a cross-sectional view of the load-carrying bed of FIG. 3 taken generally along line 4-4 of FIG. 3.
Figure 5:
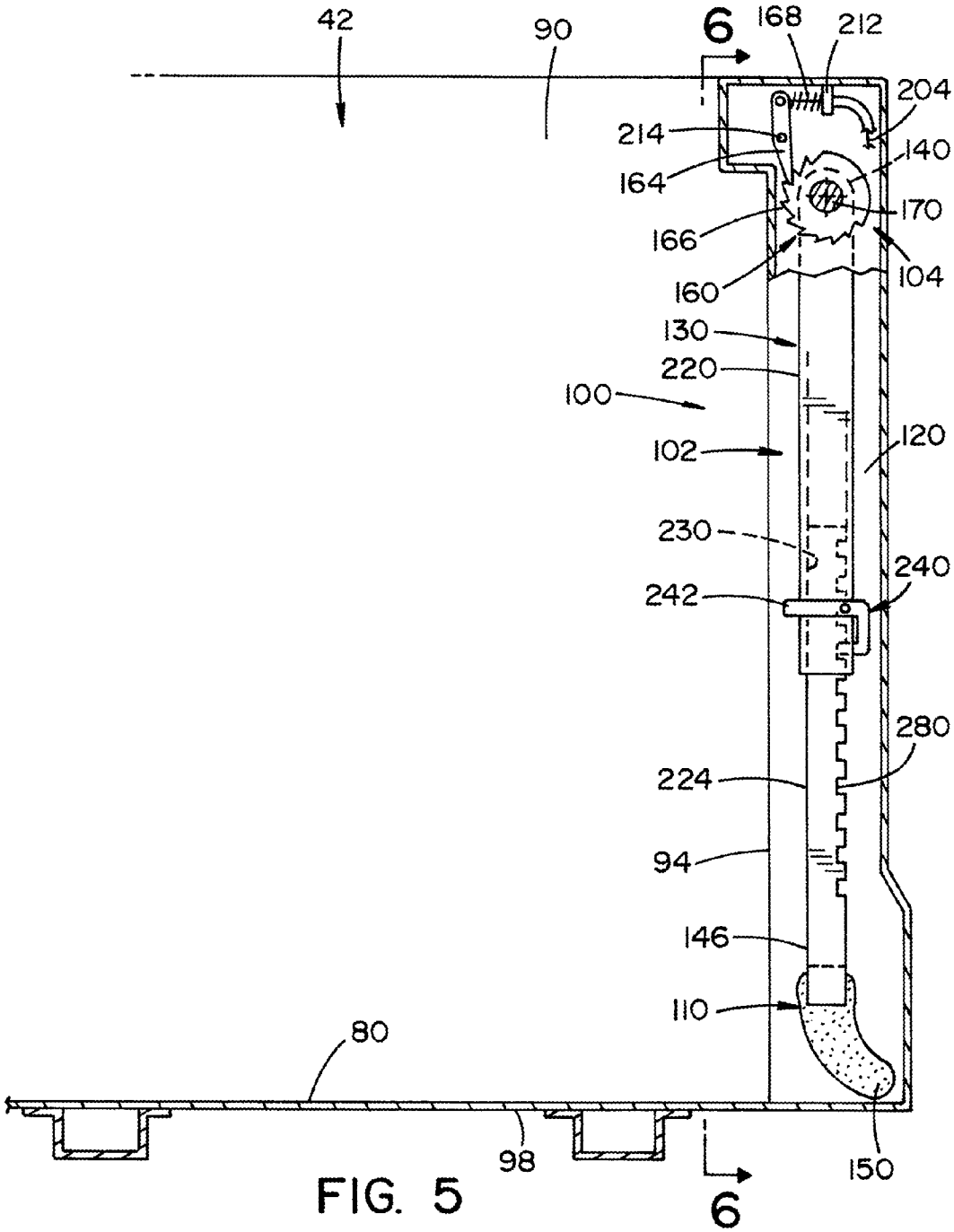
FIG. 5 is a partial cross-sectional view of the load-carrying bed of FIG. 1 showing the cargo hold-down device in a stored position.

With reference to FIGS. 3-6, an exemplary cargo hold-down device 100 is illustrated. The hold-down device 100 has a secured position (FIG. 3) for securing the cargo C within the load-carrying bed 42 of the vehicle 40 and a stored position (FIG. 5). The hold-down device 100 can be used for securing lengthy cargo, such as the depicted lumber, that is typically longer than the length of the load-carrying bed 42, even with the tailgate 60 down. In the stored position, the cargo hold-down device 100 can be positioned in the load-carrying bed 42 in such as manner as to allow full use of the load-carrying bed. The cargo hold-down device 100 comprises an engagement device 102 for engaging the cargo C located within the load-carrying bed 42 and a retaining device 104 configured to mount the engagement device to the load-carrying bed.

Figure 2:
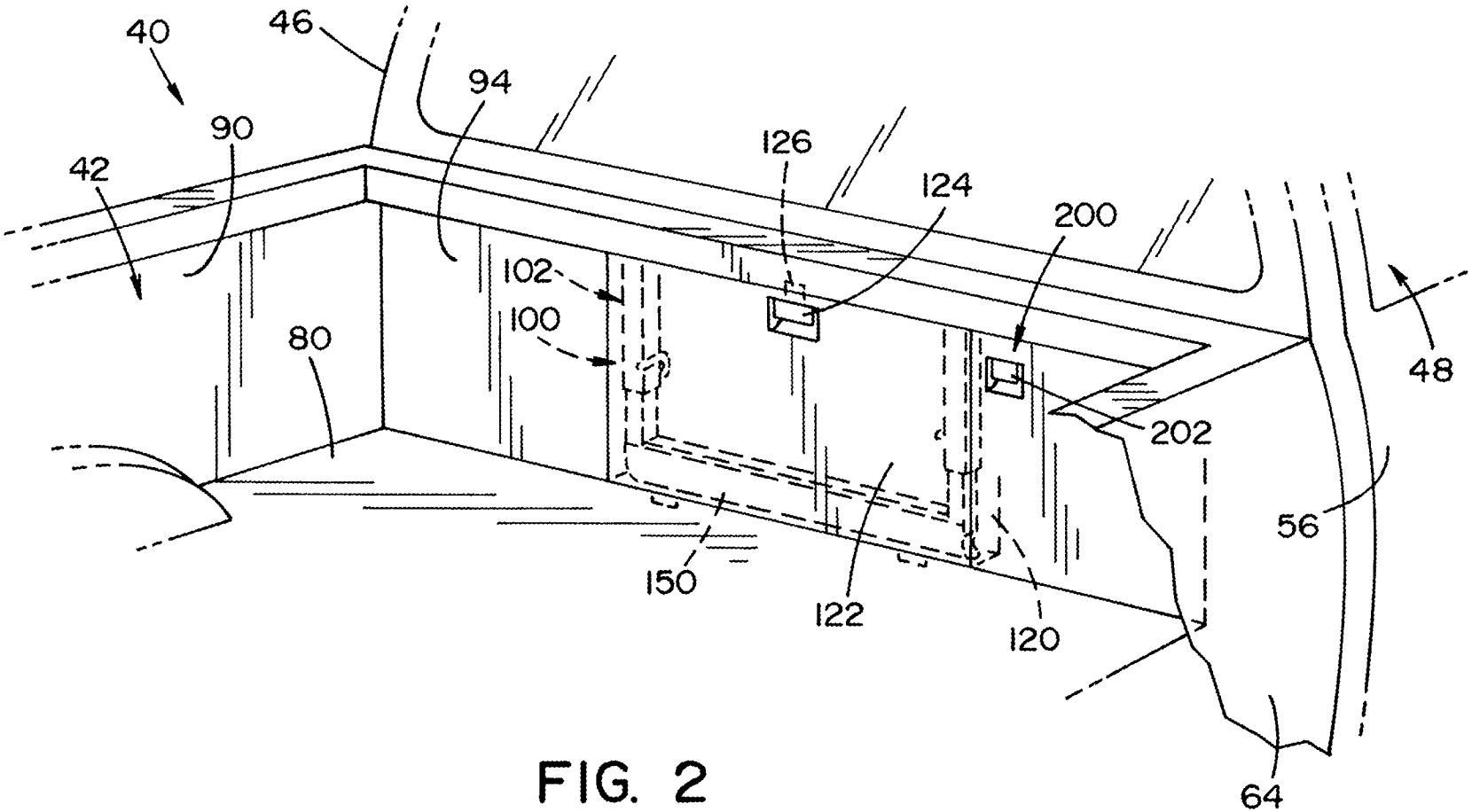
FIG. 2 is a partial perspective view of the load-carrying bed of FIG. 1 showing a cover for protecting the hold0down device.

According to one exemplary aspect, the engagement device 102 is a lengthwise adjustable swing arm having a distal end portion 110 which is at least partially deformable. In the secured position, the end portion 110 is in contact with the cargo C located within the load-carrying bed 42 such that at least a portion of the end portion 110 conforms to a contour of the cargo. The retaining device 104 is configured to hold the end portion 110 of the engagement device 102 tightly against the cargo C in the secured position. As shown in FIG. 1, the engagement device 102 can be centrally located on the forward wall 94 of the load-carrying bed 42. More particularly, in the illustrated embodiment, the forward wall 94 can include a pocket 120 dimensioned to receive the cargo hold-down device 100 in the stored position and allow pivotable or angular movement of the hold-down device 100 from the stored position to the secured position. A cover 122 (FIG. 2) can be provided on the forward wall 94 for covering the pocket 120 when the hold-down device 100 is in the stored position and protecting the hold-down device from inadvertent damage from additional cargo located in the load-carrying bed. The cover can include a handle 124 connected to a latch 126, which engages a portion of the forward wall for securing the cover to the forward wall. Although, it should be appreciated that the hold-down device 100 can be mounted directly to the forward wall 94 without a pocket. It should also be appreciated that the hold-down device 100 can be mounted to one of the side members 90, 92 instead of the forward wall 94. An attachment device can be provided which can be releasably secured to the forward wall 94 and to the retaining device 104 of the hold-down device 100.

With particular reference to FIGS. 3 and 4, the exemplary engagement device 102 is generally U-shaped and includes first and second downwardly extending arm members 130, 132 and a transverse member 134 which interconnects the first and second arm members 130, 132. As will be described in greater detail below, each of the first and second arm members 130, 132 is adjustable in length and at least a portion of the transverse member 134 which contacts the cargo C is deformable. A proximal or first end portion 140, 142 of each respective arm member 130, 132 is mounted to the forward wall 94 of the load-carrying bed 42. A distal or second end portion 146, 148 of each respective arm member 130, 132 is connected to the transverse member 134. It should be appreciated that alternative configurations for the engagement device 102 are contemplated. For example, the engagement device 102 can be generally T-shaped and include a single arm member having a proximal or first end portion mounted to the forward wall 94 and a distal or second end portion connected to the transverse member 134. Alternatively, no transverse member can be provided on the engagement device. With this configuration, the engagement device 102 includes at least one arm member having a deformable end portion for engaging the cargo.

To provide for the deformable end portion 110, the exemplary transverse member 134 of the illustrated embodiment includes an elastomeric member 150 for engaging the cargo C located within the load-carrying bed 42. The elastomeric member 150 can span the entire length of the transverse member 134; although, this is not required. As shown in FIG. 3, in the secured position, the elastomeric member 150 is configured to at least partially fold onto the cargo C, which can further secure the cargo within the load-carrying bed 42. According to one exemplary embodiment, the elastomeric member 150 is a flexible rubber strip which can be releasably secured to the transverse member 134. For example, the transverse member 134 can include an elongated channel sized aperture to receive an upper portion of the flexible rubber strip. This allows for ease of replacement of the flexible rubber strip in case of damage to the rubber strip.

With continued reference to FIGS. 3-6, the retaining device 104 can include a ratchet mechanism 160 configured to transmit intermittent motion to the engagement device 102. The ratchet mechanism 160 includes a wheel 162 and a pivoting, spring-loaded pawl 164. As is well known, and with reference to FIG. 7, the wheel 162 has inclined or sloped teeth 166 located at least partially about a circumference of the wheel. The teeth 166 are uniform but asymmetrical, with each tooth having a moderate slope on one edge and a much steeper slope on the other edge. When the teeth 166 are moving in the unrestricted direction (i.e., as the engagement device 102 moves toward the secured position), the pawl 164 easily slides up and over the gently sloped edges of the teeth 166, with a biasing member, such as spring 168, forcing the pawl 164 into the depression between the teeth as the pawl 164 passes the tip of each tooth. When the teeth 166 move in the opposite (backward) direction, however, the pawl 164 will catch against the steeply sloped edge of the first tooth it encounters, thereby locking the pawl 164 against the tooth and preventing any further motion in that direction.

Accordingly, the ratchet mechanism 160 pivotally connects the engagement device 102 to the forward wall 94 of the load-carrying bed 42 and allows for incremental angular adjustments of the distal end portion 110 of the engagement device 102 toward the cargo. As shown in FIG. 4, according to one aspect, the ratchet mechanism 160 is operatively connected to the first arm member 130 and no ratchet mechanism is connected to the second arm member 132; although, it should be appreciated that a second ratchet mechanism can be operatively connected to the second arm member 132 if desired. Additionally, when included, the second ratchet mechanism can be connected to the first ratchet mechanism by, for example, a single shaft, such that the second ratchet mechanism is released when the first ratchet mechanism 160 is released.

As shown, the retaining device 104 further includes a first axle 170 and a second axle 172. One end portion of each of the first and second axles 170, 172 is rotationally secured within a respective bearing 180, 182 and the other end of each of the first and second axles 170, 172 is attached to the respective first end portion 140, 142 of each arm member 130, 132. The bearings 180, 182 can be mounted to the forward wall 94 of the load-carrying bed 42 via conventional mounting methods. The wheel 162 of the ratchet mechanism 160 is secured to the first axle 170 between the bearing 180 and the first end portion 140 of the first arm member 130. Thus, when the engagement device 102 is in the secured position, the ratchet mechanism 160 permits the first axle 170 to rotate in one direction but not in the opposite one.

Figure 6:
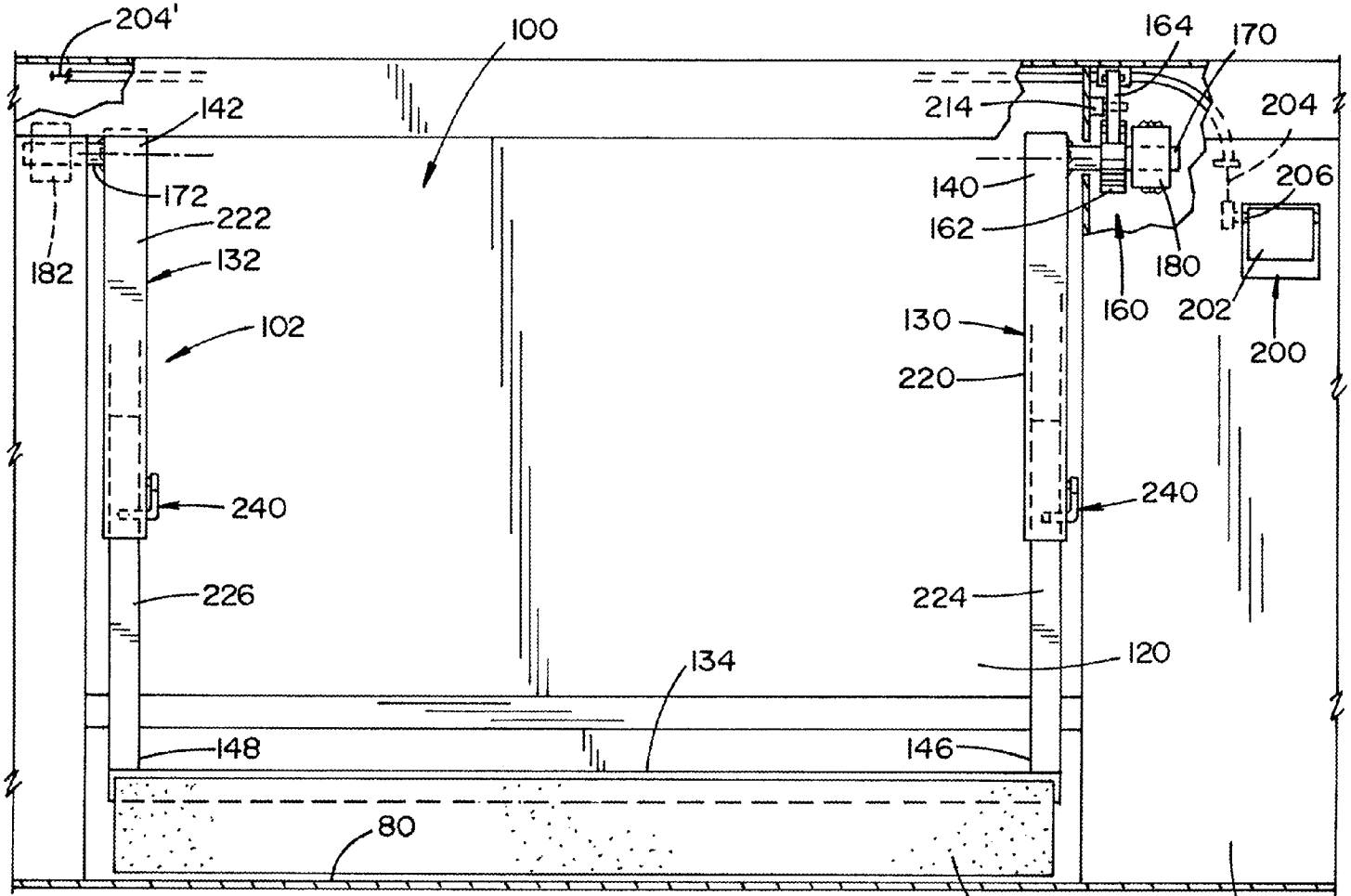
FIG. 6 is a cross-sectional view of the load-carrying bed of FIG. 5 taken generally along 6-6 of FIG. 5.
Figure 7:
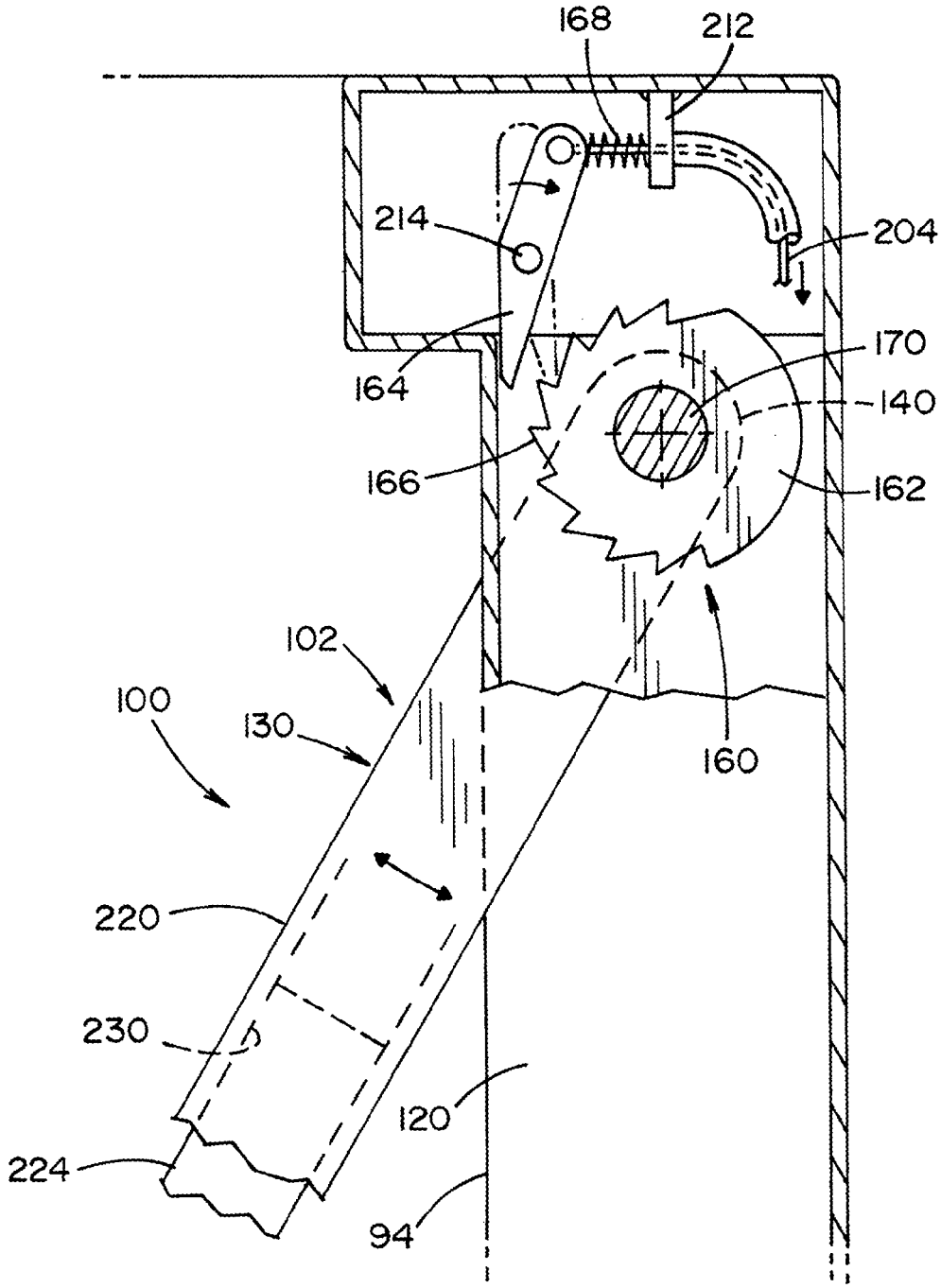
FIG. 7 is an enlarged cross-sectional view of a retaining device of the cargo hold-down device of FIG. 1 in a released position.

With reference to FIGS. 4 and 6, a release mechanism 200 is operatively coupled to the ratchet mechanism 160. In the depicted exemplary embodiment, the release mechanism 200 includes a handle 202 and a wire 204 which connects the handle 202 to the ratchet mechanism 160. One end of the wire 204 is connected to an axle 206 which rotatably supports the handle 202 and connects the handle 202 to the load-carrying bed 42. A second end of the wire 204 is connected to the pawl 164. The spring 168 circumscribes the end of the wire 204 connected to the pawl 164 and is positioned between the pawl and a stop 212, which is connected to the forward wall 94. In operation, rotation of the handle 202 causes a downward force on the wire 204 which, in turn, pivotally rotates the pawl 164 about an axle 214, which secures the pawl 164 to the forward wall 94. As the pawl 164 pivots toward the stop 212, the pawl disengages from the wheel 164. This allows the first and second arms members 130, 132 to rotate away from the forward wall 94. When the handle 202 is released, the biasing force of the spring 168 causes the pawl 164 to rotate away from the stop 212 and back into engagement with the wheel 162.

The deformable member 150 is configured to allow the engagement member 102 to move slightly downwardly against the cargo C in the secured position. Because the ratchet mechanism 160 can only stop backward motion at discrete points (i.e., at tooth boundaries), the ratchet mechanism 160 allows a limited amount of backward motion, which is limited to a maximum distance equal to the spacing between the teeth 166. This downward movement of the engagement device 102 can then at least partially release the ratchet mechanism 160. Particularly, as the engagement device 102 is moved slightly downward against the cargo C, the upward force of the teeth 166 of the wheel 162 against the pawl 164 is reduced which allows the handle 202 of the release mechanism 200 to be moved. This, in turn, causes the pawl 164 to release from the wheel 162. It should be appreciated that alternative release mechanisms for the hold-down device 100 are contemplated. For example, the release handle 202 can be operatively connected to a linkage which is connected to the ratchet mechanism 160.

In the illustrated embodiment, movement of the handle 202 causes the linkage to release the ratchet mechanism thereby allowing pivotal movement of the engagement member 102. As shown in FIG. 1, the release mechanism 200 is provided on the forward wall 94 of the load-carrying bed 42. A second release mechanism 200' can be provided on the left side member 90 in addition or in the alternative to the release mechanism 200 on the forward wall 94. This release mechanism 200' can be operatively connected to the ratchet mechanism 160 via a wire 204' in a manner similar to that described above with respect to release mechanism 200.

Figure 8:
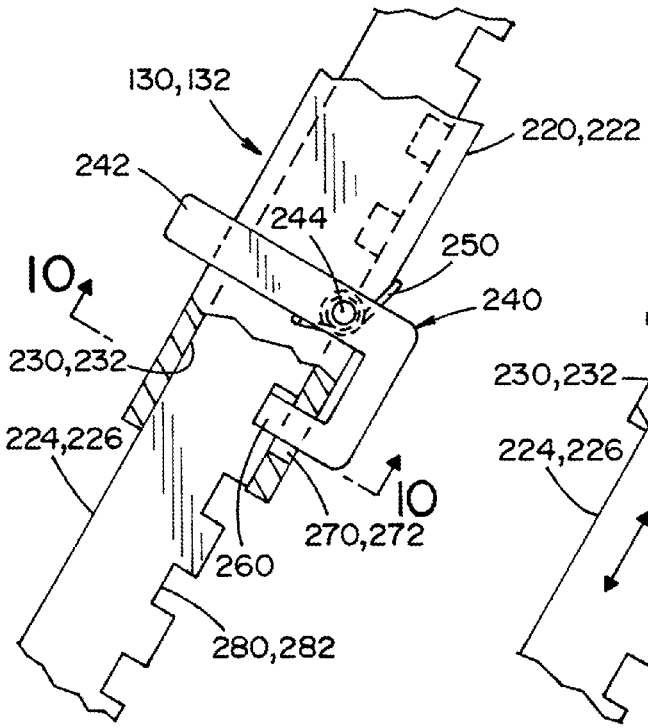
FIG. 8 is a partial cross-sectional view of an engagement device of the cargo hold-down device of FIG. 1. The engagement device includes an arm member formed of first member releasably secured to a second member by an attachment mechanism. The attachment mechanism is in a secured position.
Figure 9:
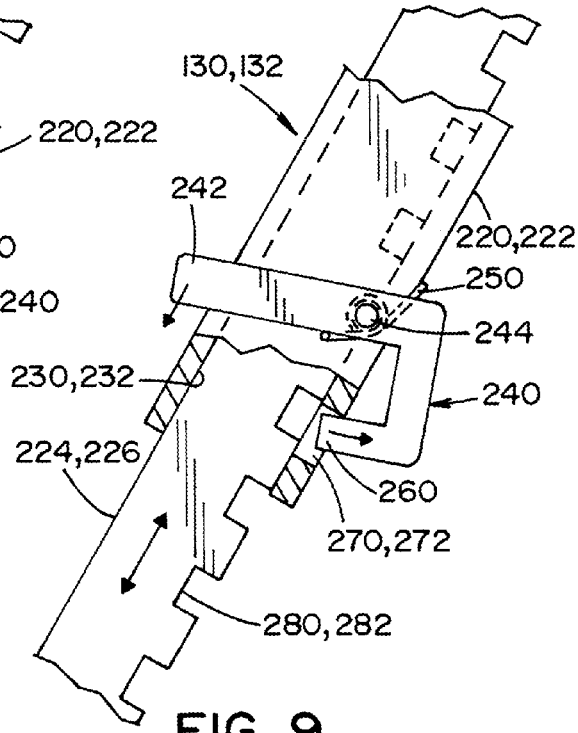
FIG. 9 is a partial cross-sectional view of the engagement device with the attachment mechanism in a partially released position.
Figure 10:
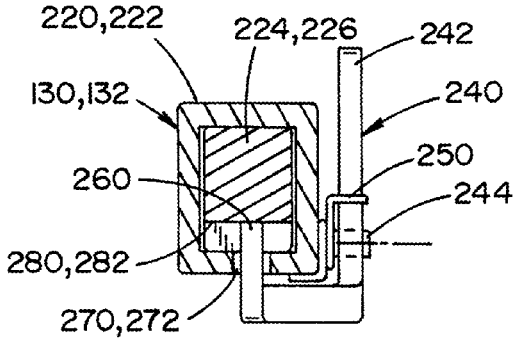
FIG. 10 is a cross-sectional view of the engagement device of FIG. 9 taken generally along 10-10 of FIG. 9.

With reference to FIGS. 8-10, and as indicated previously, each of the first and second arm members 130, 132 is adjustable lengthwise and includes a respective proximal or first end portion 140, 142 mounted to the forward wall 94 and a respective distal or second end portion 146, 148 for engaging the cargo C located within the load-carrying bed 42. According to one exemplary aspect, to allow for the lengthwise adjustment of each arm member 130, 132, each arm member 130, 132 comprises a respective first member 220, 222 and a respective second member 224, 226. The first member 220, 222 is pivotally connected to the forward wall 94 of the load-carrying bed 42. The second member 224, 226 engages the cargo. In the depicted exemplary embodiment, the second member 224, 226 is telescopically received within a respective channel 230, 232 extending lengthwise within the first member 220, 222.

To allow for lengthwise adjustments of the second member relative to the first member, an attachment mechanism 240 is provided. According to one aspect, the attachment mechanism includes an arm 242 which is rotatably connected to the first member 220, 222 via an axle 244. A biasing member, such as a torsion spring 250, is received on the axle 244 between the arm 240 and a wall of the first member 220, 222. One end of the torsion spring 250 engages the arm 242 and the other end of the torsion spring engages the first member 220, 222. The torsion spring 250 allows the arm 242 to automatically move from a released position (FIG. 9) to a secured position (FIG. 8). The arm 242 includes an end portion 260 which engages both the first member 220, 222 and the second member 224, 226. More particularly, the first member 220, 222 includes an opening 270, 272 dimensioned to received the end portion 260 in the secured position. The second member 224, 226 includes a plurality of spaced-apart notches 280, 282 dimensioned to receive the end portion 260 when one of the plurality of notches is aligned with the opening 270, 272.

To extend the first and second arm members 130, 132, the arm 242 of the attachment mechanism 240 is pivoted about the axle 244 such that the end portion 260 of the arm 242 moves out of one of the notches 280, 282 and through the opening 270, 272. The second member 224, 226 can be adjusted lengthwise depending on the size of the cargo to be retained in the load-carrying bed 42. To secure the second member to the first member, one of the notches 280, 282 is aligned with the opening 270, 272 and the arm 242 is released, the spring 250 biasing the end portion 260 of the arm 242 back through the opening and into engagement with the notch. It should be appreciated, however, that alternative manners for adjusting the first and second arm members 130, 132 are contemplated. For example, the second member of each arm 130, 132 can include a push pin and the first member of each arm can include a plurality of spaced-apart openings for receiving the push pin.

With reference to FIGS. 11-16, a cargo hold-down device 300 for securing lengthy cargo within the load-carrying bed 42 according to another exemplary embodiment is illustrated. Similar to cargo hold-down device 100, cargo hold-down device 300 comprises an engagement device 302 for engaging the cargo C and a retaining device 304 configured to mount the engagement device to the load-carrying bed. The engagement device 302 includes first and second lengthwise adjustable arm members 310, 312 and a transverse member 314 which interconnects the first and second arm members. A proximal or first end portion 320, 322 of each respective arm member 310, 312 is mounted to the forward wall 94 of the load-carrying bed 42. A distal or second end portion 326, 328 of each respective arm member 310, 312 is connected to the transverse member 314.

Figure 12:
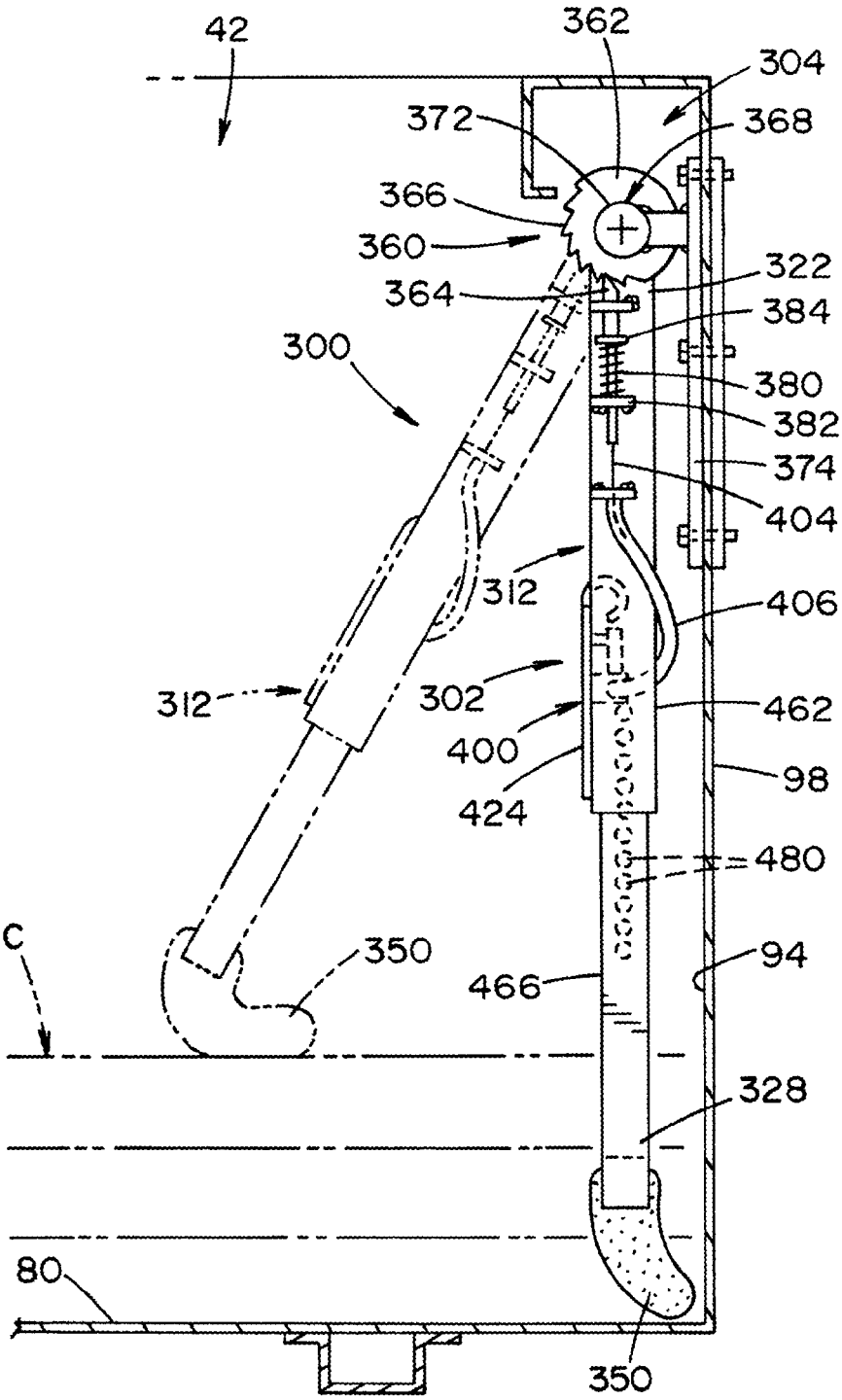
FIG. 12 is a cross-sectional view of the cargo hold-down device of FIG. 11 taken generally along 12-12 of FIG. 11, the hold-down device being shown in a stored position and a secured position.

The transverse member 314 of the illustrated embodiment includes an elastomeric member 350, such as a flexible rubber strip, for engaging the cargo C located within the load-carrying bed 42. The elastomeric member 350 can span the entire length of the transverse member 314; although, this is not required. As shown in FIG. 12, in a secured position, the elastomeric member 350 is configured to at least partially fold onto the cargo C, which can further secure the cargo within the load-carrying bed 42.

The retaining device 304 is configured to pivotally mount the first end portion 320, 322 of each arm member 310, 312 to the forward wall 94. The retaining device allows for incremental angular adjustments of the second end portion 326, 328 of each arm member 310, 312 toward the cargo C to hold the second end portions of the arm members tightly against the cargo in a secured position. With continued reference to FIGS. 11-13, the retaining device 304 can include a ratchet mechanism 360 configured to transmit intermittent motion to the engagement device 302. According to one exemplary embodiment, a ratchet mechanism 360 is associated with each of the first and second arm members 310, 312; although, this not required. The ratchet mechanism 360 includes a wheel 362 and a spring-loaded pawl 364. The wheel 362 has inclined or sloped teeth 366 located at least partially about a circumference of the wheel. The wheel 362 is fixedly secured to a shaft 368 having a first end portion 370 coupled to the first end portion 320, 322 of each arm member 310, 312 and a second end portion 372 secured to an attachment device 374. The first and second arm members 310, 312 rotate about the first end portion 370 of the shaft 368. The attachment device 374 securely mounts the shaft 368 to the load-carrying bed 42.

As will be described in greater detail below, when the first and second arm members 310, 312 are moved downwardly into engagement with the cargo C, the pawl 364 easily slides up and over the gently sloped edges of the teeth 366, with a biasing member, such as spring 380, forcing the pawl 364 into the depression between the teeth as the pawl passes the tip of each tooth. As shown, the spring 380 is positioned between a flange 382 fixed to the first end portion 320, 322 and a lip 384 provided on the pawl 364. An end of the pawl extends through an opening located on the flange. When the first and second arm members 310, 312 move in the opposite (backward) direction, however, the pawl 364 will catch against the steeply sloped edge of the first tooth it encounters, thereby locking the pawl 364 against the tooth and preventing any further motion of the first and second arm members 310, 312 in that direction.

With reference to FIGS. 11-14, release mechanisms 400 are operatively coupled to the ratchet mechanisms 360 associated with the first and second arm members 310, 312. In the depicted exemplary embodiment, the release mechanism 400 is moveable with the engagement device 302 and includes a handle 402 and a wire 404 which connects the handle 402 to the ratchet mechanism 360. A sleeve 406 can be provided to protect the wire from damage. As shown, the handle 402 is generally L-shaped an includes a elongated first portion 410 for gripping by a user and a second portion 412 which extends generally perpendicular from the first portion. The handle 402 is pivotally connected to an inside surface of a cover 420 via an axle 422. The cover protects the release mechanisms 400 and includes a planar portion 424 and a rolled portion 426. The planar portion 424 is connected to the first and second arm members 310, 312 and the rolled portion 426 spans between the first and second arm members. One end of the wire 404 is connected to the second portion 412 and the other end of the wire is connected to the pawl 364. In operation, upward rotation of the handle 402 pulls the wire 404 which, in turn, moves the pawl downwardly away from the wheel 362.

As the pawl disengages from the wheel, the first and second arms members 310, 312 can rotate away from the forward wall 94. When the handle 402 is released, the biasing force of the spring 380 causes the pawl 364 to move upwardly and back into engagement with the wheel 362. It should be appreciated that instead of the wire 404, a linkage can connect the handle 402 to the ratchet mechanism 360.

Similar to the previous embodiment, the deformable member 350 is configured to allow the engagement member 302 to move slightly downwardly against the cargo C in the secured position. The cover 420 allows the user to force the engagement device 302 against the cargo C. Because the ratchet mechanism 360 can only stop backward motion at discrete points (i.e., at tooth boundaries), the ratchet mechanism 360 allows a limited amount of motion, which is limited to a maximum distance equal to the spacing between the teeth 366. This downward movement of the engagement device 302 can then at least partially release the ratchet mechanism 360 allowing the handles 402 to be easily moved. The location of the release mechanisms 400 on the cover 420 allows the user to easily move the handles 402 as the user is forcing the engagement device 302 downwardly.

Figure 15:
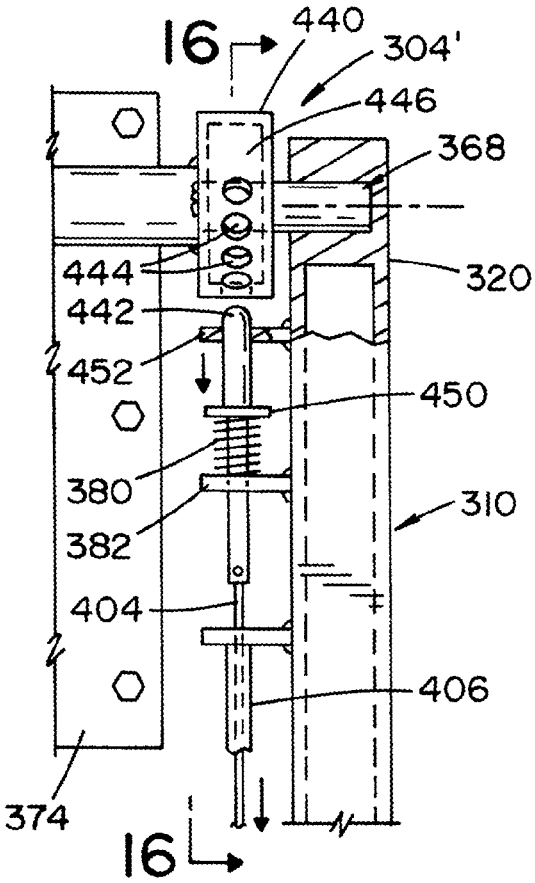
FIGS. 15 and 16 are enlarged views of a retaining device of the cargo hold-down device of FIG. 11 in a released position.
Figure 16:
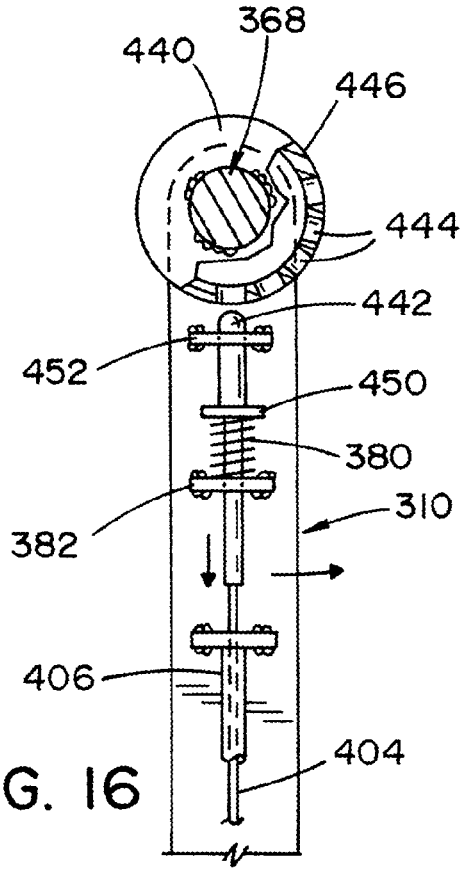

With reference to FIGS. 15 and 16, an alternative exemplary embodiment of a retaining device 304' for pivotally mounting the first end portion 320, 322 of each arm member 310, 314 to the forward wall 94 is illustrated. The retaining device allows for incremental angular adjustments of the second end portion 326, 328 of each arm member 310, 312 toward the cargo C to hold the second end portions of the arm members tightly against the cargo in a secured position. The retaining device 304' includes a wheel 440 and a spring-loaded pin 442. The wheel 440 has a plurality of circumferentially spaced openings 444 located on its outer radial surface 446 and dimensioned to receive the pin 442. The wheel 440 is fixedly secured to the shaft 368 in a similar manner described above, and the first and second arm members 310, 312 rotate about the shaft 368. As shown, the spring 380 is positioned between the flange 382 and a lip 450 provided on the pin 442. One end of the pin extends through an opening located on the flange 382 and the other end of the pin extends through an opening located on a flange 452, which is also fixed to the first end portion 320, 322. In operation, as the handle 402 is pulled, the wire 404 pulls the pin downwardly disengaging the pin from one of the openings located on the wheel.

Figure 11:
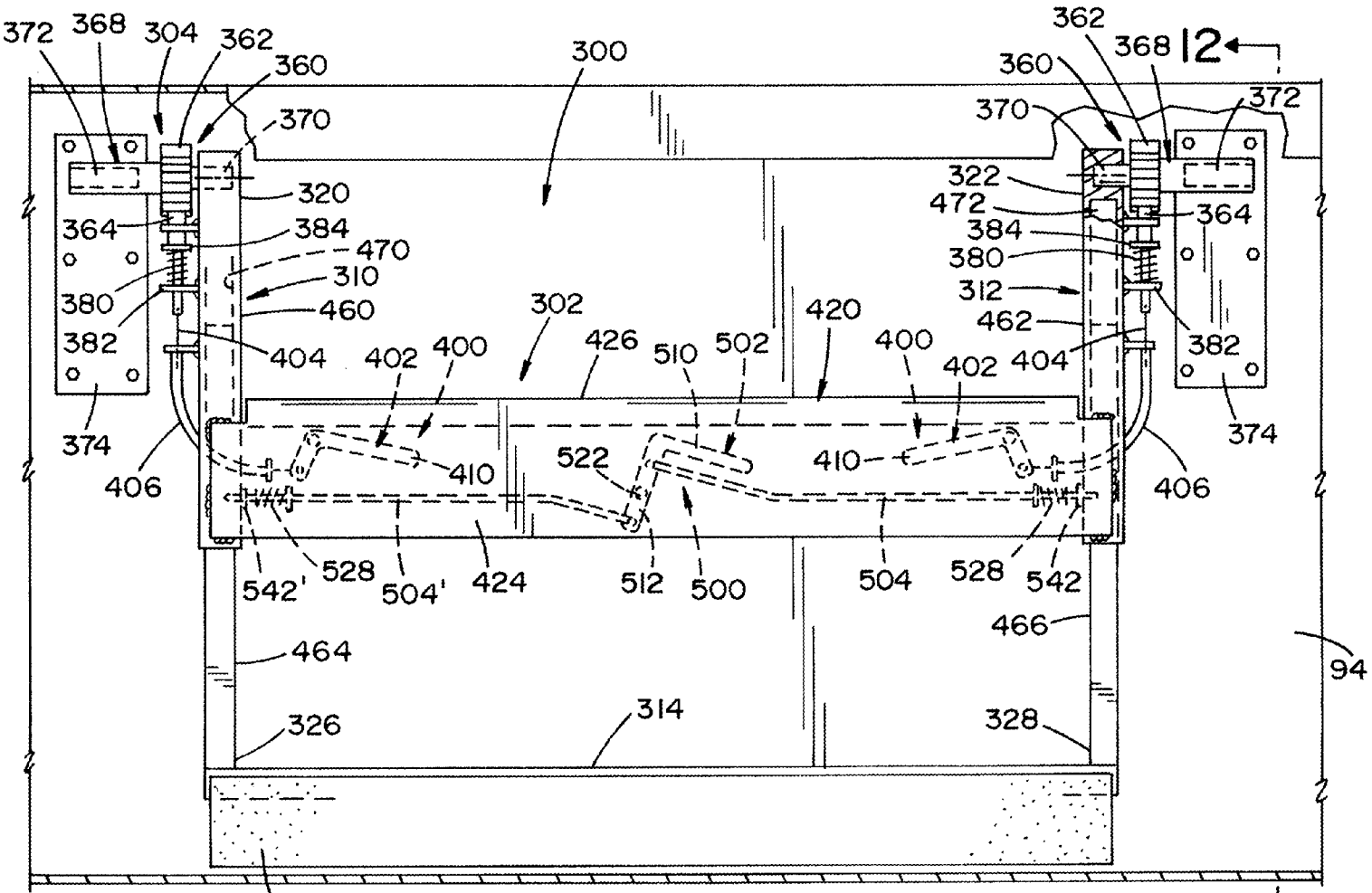
FIG. 11 is a front perspective view of an exemplary cargo hold-down device according to another aspect of the present disclosure.
Figure 13:
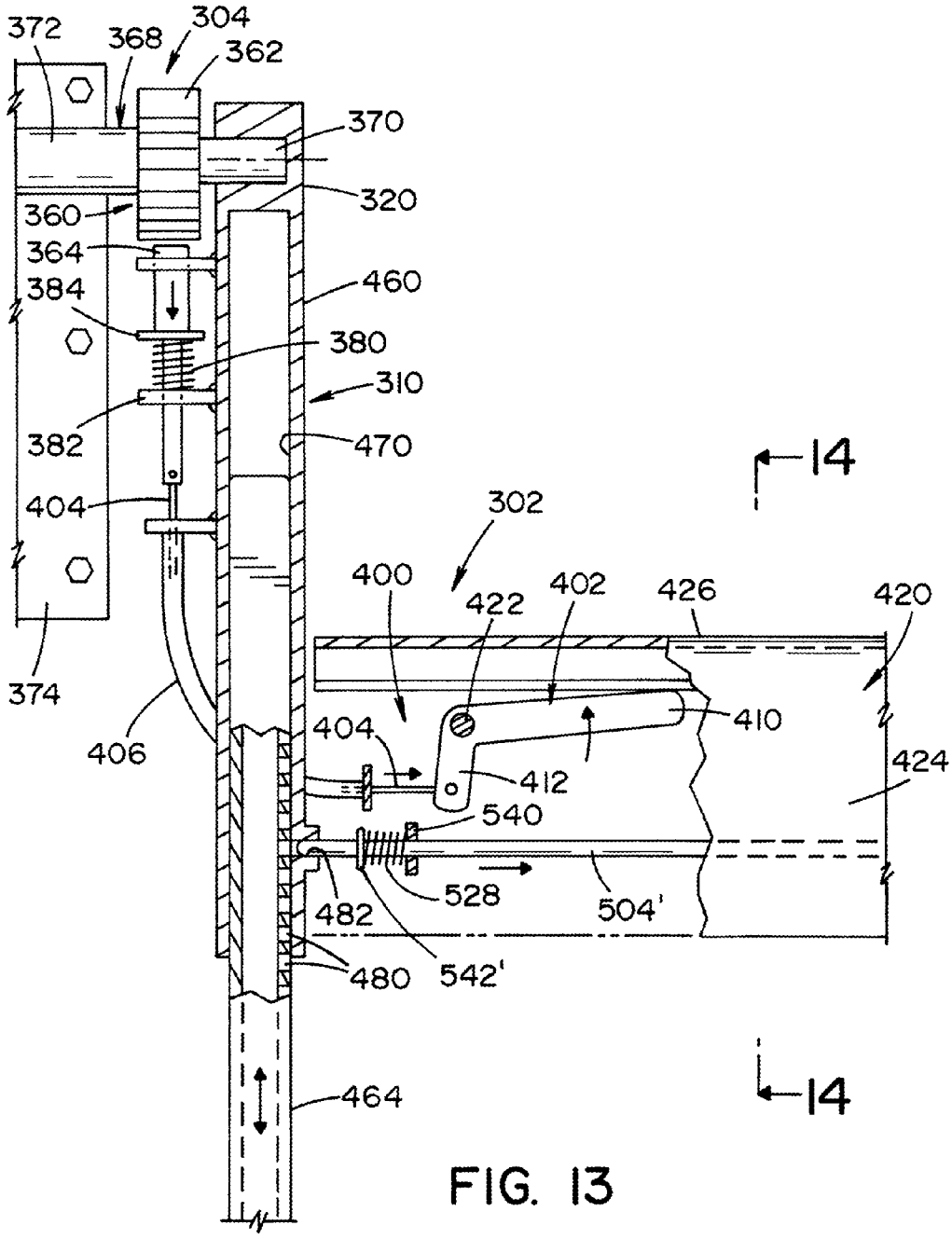
FIG. 13 is a partial cross-sectional view of the cargo hold-down device of FIG. 11 showing a retaining device and a release mechanism associated with the retaining device.
Figure 14:
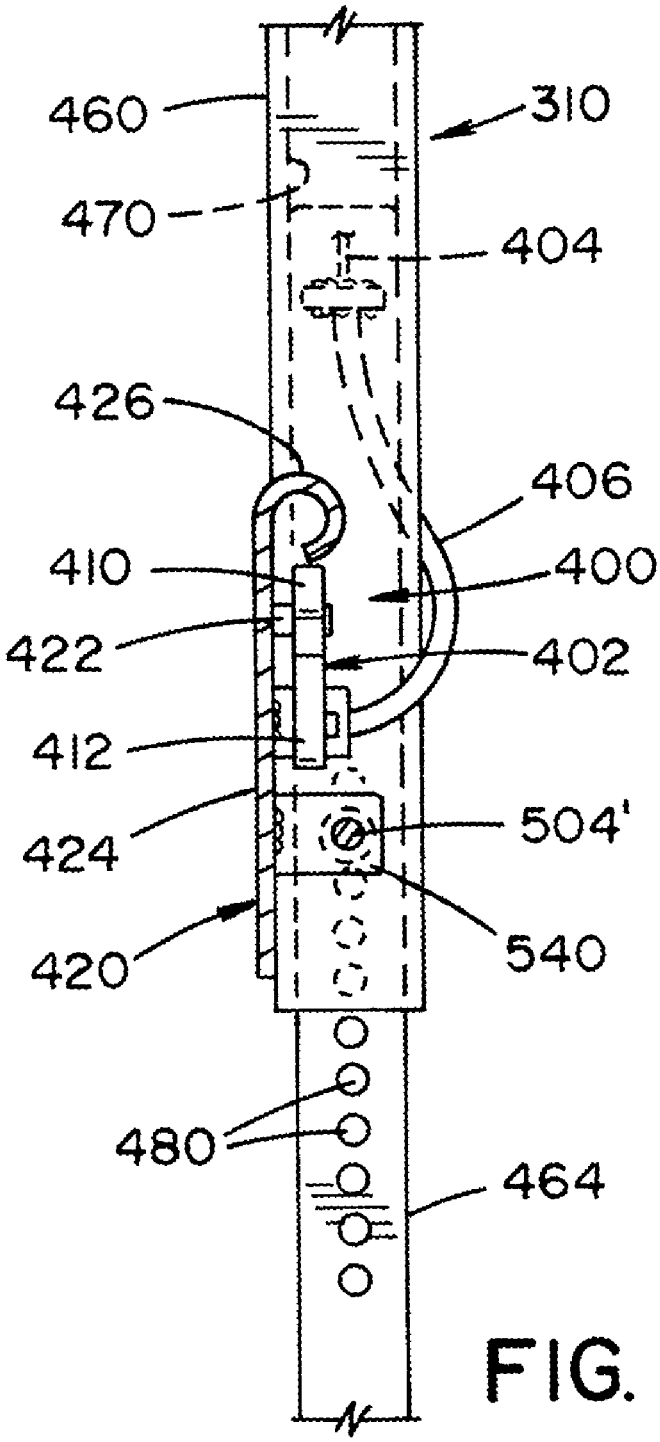
FIG. 14 is a cross-sectional view of an engagement device of FIG. 13 taken generally along 14-14 of FIG. 13.

With reference to FIGS. 11 and 13, and as indicated previously, each of the first and second arm members 310, 312 are lengthwise adjustable. According to one exemplary aspect, each arm member 310, 312 comprises a respective first member 460, 462 and a respective second member 464, 466. The first member 460, 462 is pivotally connected to the forward wall 94 of the load-carrying bed 42. The second member 464, 466 engages the cargo and is telescopically received within a respective channel 470, 472 extending lengthwise within the first member 460, 462. To allow for lengthwise adjustments of the second member relative to the first member, the second member 464, 466 includes a plurality of spaced apart openings 480 which are selectively aligned with an opening 482 provided on the first member 460, 462.

A release mechanism 500 (FIG. 11) is operatively connected to the first and second arm members 310, 312 for selectively securing the first member 460, 462 to the second member 464, 466. In the depicted exemplary embodiment, the release mechanism 500 includes a generally L-shaped handle 502 and pins 504, 504' coupled to the handle. The pins are movably received in the openings 480, 482. The handle 502 has a first portion 510 for gripping by a user and a second portion 512 which extends generally perpendicular from the first portion. The handle 502 is pivotally connected to an inside surface of the cover 420 via an axle 522. Each pin is connected to the second portion 512. A biasing member, such as a spring 528, is provided on each pin 504, 504' for biasing the pins through the openings 480, 482. Each biasing member circumscribes an end portion of each pin and is positioned between a flange 540 fixed to the cover 420 and a lip 542, 542' located on each pin 504, 504'. The lips can also serve as a stop for limiting the movement of the pins through the openings. In operation, upward rotation of the handle 502 pulls the pins 504, 504' which, in turn, moves the pins out of the openings 480, 482 and away from the first and second arm members 310, 312. The second member 464, 466 can be adjusted lengthwise relative to the first member 460, 462 depending on the size of the cargo to be retained in the load-carrying bed 42. When the handle 502 is released, the biasing force of the springs 528 causes the pins to move through the aligned openings 480, 482 thereby securing the first and second members together. It should be appreciated, however, that alternative manners for adjusting the first and second arm members 310, 312 are contemplated.

Figure 17:
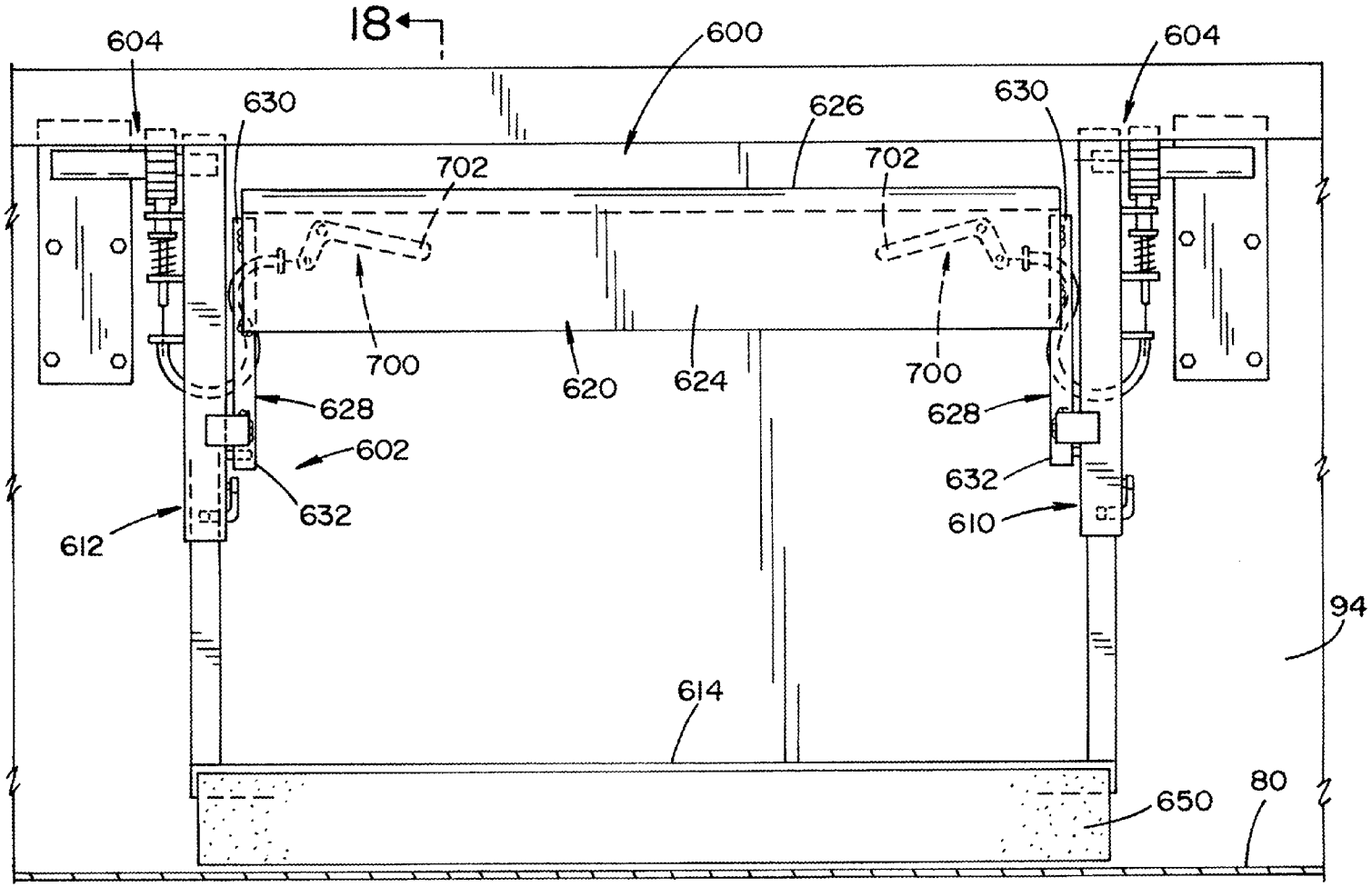
FIG. 17 is a front perspective view of an exemplary cargo hold-down device according to yet another aspect of the present disclosure.
Figure 18:
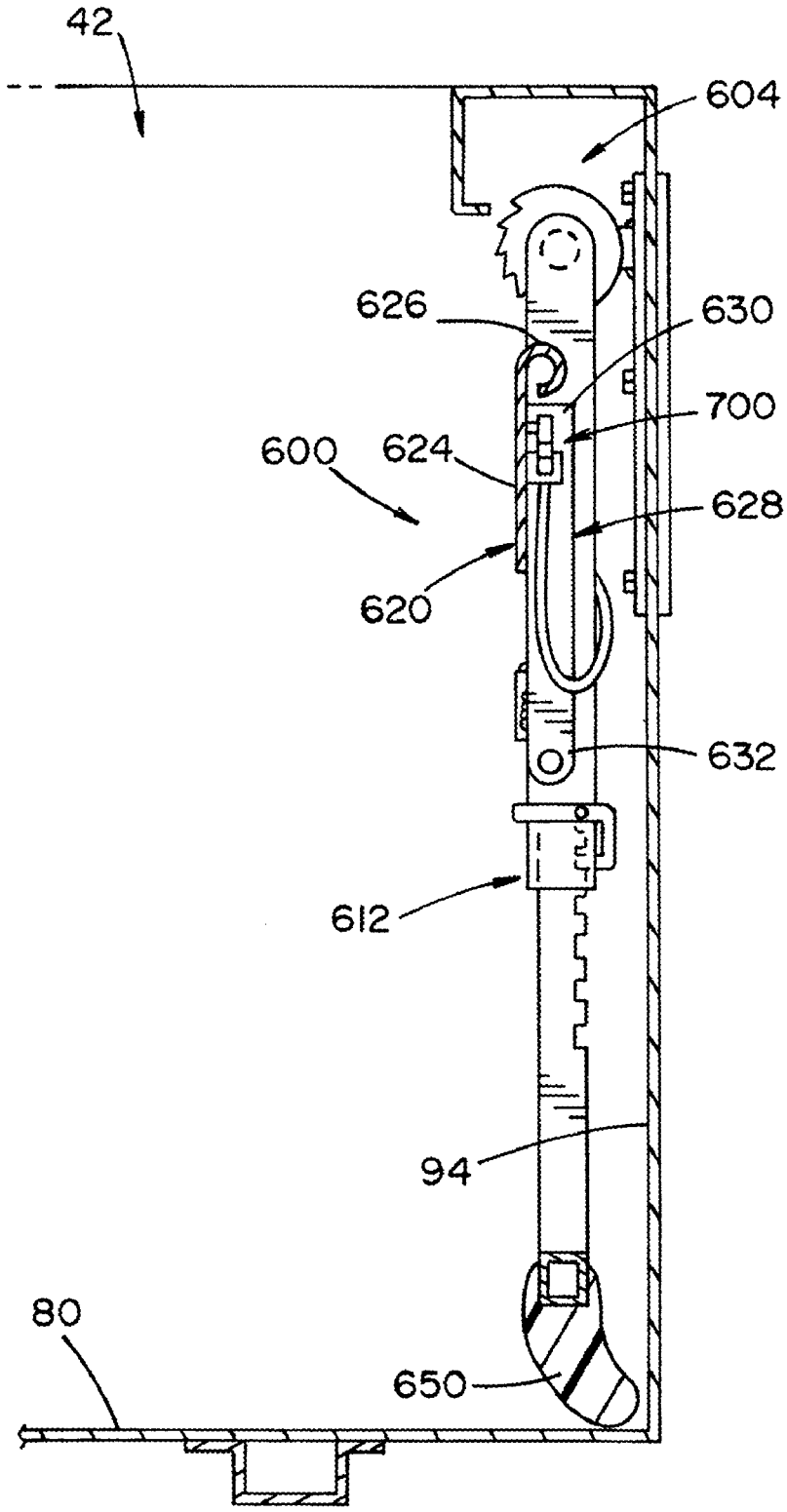
FIG. 18 is a cross-sectional view of the cargo hold-down device of FIG. 17 taken generally along 18-18 of FIG. 17, the hold-down device being shown in a stored position.
Figure 19:
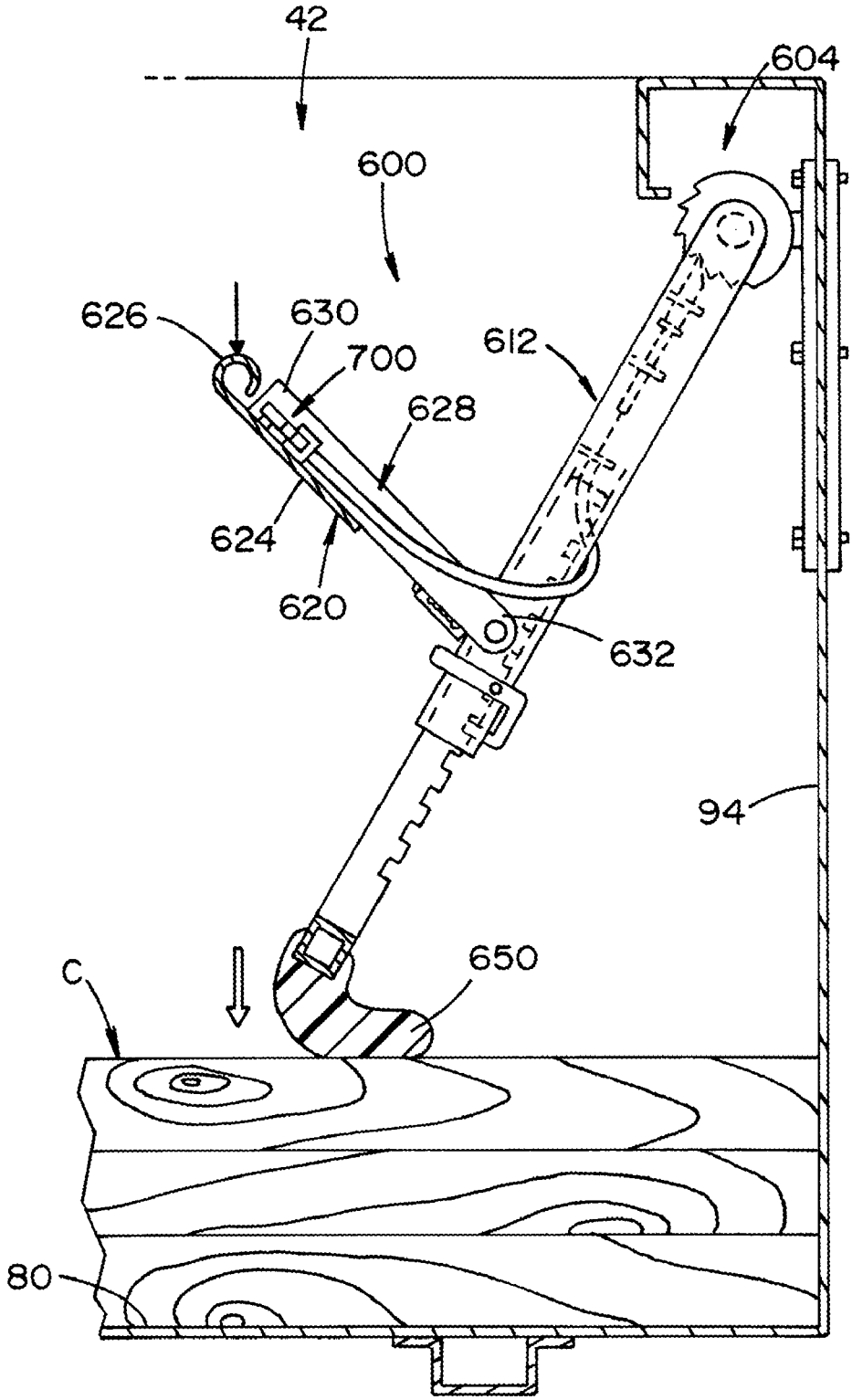
FIG. 19 is a cross-sectional view of the cargo hold-down device of FIG. 17 in a secured position.

With reference to FIGS. 17-19, a cargo hold-down device 600 for securing lengthy cargo within the load-carrying bed 42 according to another exemplary embodiment is illustrated. Similar to cargo hold-down devices 100 and 300, cargo hold-down device 600 comprises an engagement device 602 for engaging the cargo C and a retaining device 604 configured to mount the engagement device to the load-carrying bed. The engagement device 602 includes first and second lengthwise adjustable arm members 610, 612 and a transverse member 614 which interconnects the first and second arm members. The transverse member 614 includes an elastomeric member 650, such as a flexible rubber strip, for engaging the cargo C located within the load-carrying bed 42.

The first and second arm members 610, 612 are lengthwise adjustable in a manner similar to the first and second arms 130, 132. The retaining devices 604 allow for incremental angular adjustments of each arm member 610, 612 in a manner similar to retaining device 304. Release mechanisms 700 are operatively coupled to the retaining devices in a manner similar to release mechanisms 400. Therefore, further discussion of the first and second arm members 610, 612, retaining devices 604 and release mechanisms 700 is omitted for conciseness.

Each release mechanism 700 is operatively connected to a cover 620 which spans between the first and second arm members 610, 612. Similar to cover 420, cover 620 is connected to the engagement device 602 for movement therewith and includes a planar portion 624 and a rolled portion 626. The cover 620 allows the user to force the engagement device 602 tightly against the cargo C. The location of the release mechanisms 700 on the cover 620 allows the user to easily move the handles 702 as the user is forcing the engagement device 602 downwardly. In the depicted exemplary embodiment, the cover 620 is pivotally connected to the arm members 610, 612. Particularly, the cover includes arms 628 having first end sections 630 connected to the planar portion 624 and second end sections 632 pivotally connected to the first and second arm members 610, 612. As shown in FIG. 19, this allows the cover 620 to move downwardly about the arms 628 which allows the user to apply further pressure against the cargo C. A biasing member (not shown) can be provided for automatically returning the cover from an extended position (FIG. 19) to a stowed position (FIG. 18). A locking mechanism can also be provided for securing the cover 620 in the stowed position.

As is evident from the foregoing, the exemplary cargo hold-down device (100,300,600) secures long cargo C in the load-carrying bed 42 of the vehicle 40. The hold-down device (100,300,600) mounts to the forward bed wall 94 and includes the downwardly extending engagement device or swing arm (102,302,602) with a flexible elastomeric or rubber end portion (150,350,650). The engagement device is pivotally connected to the bed wall 94 by a pivoting retaining device (104,304,604). When the long cargo is placed in the load-carrying bed 42, one end thereof is placed against the forward bed wall 94. The engagement device is raised to receive the cargo. The engagement device is then moved downward and into contact with the cargo, where it is held tightly there by the retaining device. The flexible rubber end (150,350,650) of the engagement device (102,302,602) allows for a slight downward movement of the engagement device, so as to at least partially release the retaining device when the cargo C is secured.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A cargo hold-down device for securing cargo within a load-carrying bed of a vehicle, the cargo hold-down device comprising:

an engagement device located on a forward wall of the load-carrying bed and having a proximal end portion and a distal end portion for engaging cargo located within the load-carrying bed; and a retaining device movably mounting the proximal end portion of the engagement device to the load-carrying bed and selectively holding the distal end portion of the engagement device tightly against the cargo in a secured position.

2. The cargo hold-down device of claim 1, wherein the engagement device includes first and second downwardly extending arm members, each arm member being adjustable in length.

3. The cargo hold-down device of claim 2, wherein the engagement device includes a transverse member interconnecting the first and second arm members, at least a portion of the transverse member which contacts the cargo being deformable.

4. The cargo hold-down device of claim 3, wherein the transverse member includes an elastomeric member for engaging the cargo.

5. The cargo hold-down device of claim 4, wherein the elastomeric member spans the entire length of the transverse member, the elastomeric member being configured to at least partially fold onto the cargo.

6. The cargo hold-down device of claim 5, wherein the elastomeric member is a flexible rubber strip secured to the transverse member.

7. The cargo hold-down device of claim 1, wherein the retaining device includes a ratchet mechanism, the ratchet mechanism pivotally connecting the engagement device to a forward wall of the load-carrying bed allowing for incremental angular adjustments of the distal end portion of the engagement device toward the cargo.

8. The cargo hold-down device of claim 7, wherein the distal end portion is an elastomeric member configured to allow the engagement device to move slightly downward against the cargo in the secured position, the downward movement at least partially releasing the ratchet mechanism.

9. The cargo hold-down device of claim 1, further including a release mechanism operatively connected to the retaining device, the release mechanism being movable with the engagement device.

10. The cargo hold-down device of claim 9, further including a cover connected to the engagement device, the release mechanism being mounted to the cover.

11. The cargo hold-down device of claim 10, wherein the cover is pivotally connected to the engagement device.

12. A cargo hold-down device for securing lengthy cargo within a load-carrying bed of a vehicle, the cargo hold-down device comprising:

a lengthwise adjustable arm having a first end portion mounted to a forward wall of the load-carrying bed and a second end portion movable relative to the first end portion for engaging cargo located within the load-carrying bed; and a retaining device configured to pivotally mount the first end portion of the arm to the forward wall, the retaining device allowing for incremental angular adjustments of the second end portion of the arm toward the cargo to hold the second end portion of the arm tightly against the cargo in a secured position.

13. The cargo hold-down device of claim 12, wherein the second end portion includes a flexible rubber strip for engaging the cargo.

14. The cargo hold-down device of claim 12, wherein the retaining device includes a ratchet mechanism mounted to the forward wall of the load-carrying bed.

15. The cargo hold-down device of claim 14, further including a first release mechanism operatively connected to the ratchet mechanism for releasing the ratchet mechanism and a second release mechanism operatively connected to the arm for allowing lengthwise adjustment of the arm.

16. The cargo hold-down device of claim 15, further including a cover connected to the arm and movable therewith, the first and second release mechanisms being mounted to the cover.

17. A cargo hold-down device for securing cargo within a load-carrying bed of a vehicle, the cargo hold-down device comprising:

a lengthwise adjustable arm having a first end portion mounted to a forward wall of the load-carrying bed and a second deformable end portion for engaging cargo located within the load-carrying bed; and a ratchet mechanism configured to pivotally mount the first end portion of the arm to the forward wall, the ratchet mechanism holding the second end portion of the arm tightly against the cargo in a secured position.

18. The cargo hold-down device of claim 17, wherein the arm is generally U-shaped and the second end portion includes an elastomeric member extending generally parallel to the forward wall.

19. The cargo hold-down device of claim 18, wherein the elastomeric member is a flexible rubber strip secured to the second end portion.

* * * * *